US007954299B2

(12) United States Patent
Platts

(10) Patent No.: US 7,954,299 B2
(45) Date of Patent: Jun. 7, 2011

(54) METHOD OF HOLDING DOWN ROOF SHEATHING AND SHINGLES

(75) Inventor: Robert E. Platts, Ottawa (CA)

(73) Assignee: Building Performance Americas Ltd., Grand Cayman (KY)

( * ) Notice: Subject to any disclaimer, the term of this patent is extended or adjusted under 35 U.S.C. 154(b) by 296 days.

(21) Appl. No.: 12/195,746

(22) Filed: Aug. 21, 2008

(65) Prior Publication Data

US 2009/0049795 A1 Feb. 26, 2009

Related U.S. Application Data

(60) Provisional application No. 60/957,294, filed on Aug. 22, 2007.

(51) Int. Cl.
*E04G 23/00* (2006.01)
*E04D 1/00* (2006.01)

(52) U.S. Cl. ..... 52/745.21; 52/748.1; 52/748.11; 52/521; 52/410

(58) Field of Classification Search ..... 52/309.7, 52/309.9, 309.15, 309.16, 518, 520, 521, 52/543, 409, 408, 410, 746.11, 746.1, 748.1, 52/748.11, 745.21, 515, 516; 428/139, 104
See application file for complete search history.

(56) References Cited

U.S. PATENT DOCUMENTS

| | | | | | |
|---|---|---|---|---|---|
| 1,438,780 | A * | 12/1922 | O'Neil | 52/540 |
| 1,650,285 | A * | 11/1927 | Lindley | 52/545 |
| 2,230,702 | A * | 2/1941 | Siebert | 52/385 |
| 2,264,546 | A * | 12/1941 | Ochs | 52/521 |
| 2,394,380 | A * | 2/1946 | Herbes | 52/748.11 |
| 3,919,822 | A * | 11/1975 | Martin et al. | 52/540 |
| 4,160,346 | A * | 7/1979 | Kaufmann | 52/96 |
| 4,256,804 | A * | 3/1981 | Jasperson | 428/332 |
| 4,393,634 | A * | 7/1983 | McDermott et al. | 52/309.1 |
| 4,686,808 | A * | 8/1987 | Triplett | 52/410 |
| 5,746,027 | A * | 5/1998 | Bonerb | 52/1 |
| 5,950,387 | A | 9/1999 | Stahl et al. | |
| 6,852,185 | B2 | 2/2005 | Sanger | |
| 6,936,329 | B2 | 8/2005 | Kiik et al. | |
| 6,968,662 | B2 | 11/2005 | Rodrigues | |
| 7,281,358 | B2 * | 10/2007 | Floyd | 52/518 |
| 7,662,221 | B2 * | 2/2010 | Fay | 106/15.05 |
| 2009/0158652 | A1 * | 6/2009 | Yoshida et al. | 47/65.9 |

* cited by examiner

*Primary Examiner* — Robert J Canfield
*Assistant Examiner* — Brent W Herring
(74) *Attorney, Agent, or Firm* — Marjama Muldoon Blasiak & Sullivan LLP

(57) ABSTRACT

A method for securing a roof sheathing and shingles in a retrofitting reinforcement of an existing roof structure, the shingles being laid on the roof sheathing in a partially overlapping pattern, comprises (a) driving a plurality of fasteners down through selected shingles and the roof sheathing in a selected area of the roof structure into at least one of underlying roof frames; and (b) applying a water-resistant coating to the roof structure to seamlessly cover exposed surfaces with exposed ends and sides of all shingles in the selected area.

5 Claims, 2 Drawing Sheets

METHOD OF HOLDING DOWN ROOF SHEATHING AND SHINGLES

CROSS-REFERENCE TO RELATED APPLICATIONS

This application claims priority under 35 U.S.C. §119(e) of U.S. Provisional Patent Application Ser. No. 60/957,294 entitled METHOD OF HOLDING DOWN ROOF DECK AND SHINGLES and filed on Aug. 22, 2007.

TECHNICAL FIELD

The present invention relates to a roof structure of buildings, and more particularly to a method of securing the roof sheathing and shingles of existing structures against winds.

BACKGROUND OF THE ART

Studies of building damage caused by high winds, hurricanes and tornadoes indicate that serious damage very commonly occurs as the roof sheathing, panel or deck (roof sheathing will be only used hereinafter) is torn off, allowing rain to ruin the ceiling and interior construction and contents below and often allowing walls to collapse as well. Further, the torn-off roof sheathings and shingles become wind-borne missiles that can damage or destroy anything in their path including the windows of neighbouring structures leaving those buildings prone to greater damage as well.

Roof sheathings can be securely anchored to the underlying frames such as trusses or rafters during construction. Such practice is now generally followed in hurricane and tornado high risk areas of the United States. In most existing houses at risk, however, the roof sheathing is inadequately fastened down, and this is not easily corrected. Further, even if the roof sheathing does hold intact, the shingles themselves can be "pried off" by high winds. Retrofit reinforcement of existing roof sheathing requires costly removal and replacement of the roofing shingles in order to drive fasteners to secure the roof sheathing to the underlying roof frames.

Therefore, there is a need for an improved method for securing a roof sheathing and shingles in a retrofitting reinforcement of an existing roof structure.

SUMMARY OF THE INVENTION

In accordance with one aspect of the present invention, there is a method for securing a roof sheathing and shingles in a retrofitting reinforcement of an existing roof structure, the shingles being laid on the roof sheathing in a partially overlapping pattern, the method comprising a) driving a plurality of fasteners down through selected shingles and the roof sheathing in a selected area of the roof structure into at least one of underlying roof frames; and b) applying a water-resistant coating to the roof structure to form a continuous membrane over the selected area of the roof structure covering exposed ends and sides seamlessly with exposed to surfaces of all shingles in the selected area, thereby sealing fastener penetrations against water entry while preventing winds from prying off the shingles.

In accordance with another aspect of the present invention, there is a method for retrofitting reinforcement of an existing roof structure, the roof structure including a roof sheathing supported on a plurality of underlying roof frames, and a plurality of shingles laid on the roof sheathing in a partially overlapping pattern, the method comprising a) driving a plurality of fasteners down through selected shingles and through the roof sheathing into selected underlying roof frames, each of the fasteners being driven through at least one layer of overlapping shingles to cause an enlarged portion of a top of the fastener to abut the roof sheathing; and b) applying a water-resistant coating to form a continuous membrane over an entire surface of the roof structure, seamlessly covering the tops of the respective fasteners and top exposed surfaces with exposed ends and sides of all the shingles, thereby sealing fastener penetrations against water entry while preventing winds from prying off the shingles.

Other features and aspects will be further described in the preferred embodiments described hereinafter with reference to the accompanying drawings.

BRIEF DESCRIPTION OF THE DRAWINGS

Reference is now made to the accompanying drawings, by way of examples showing the embodiments, in which.

DETAILED DESCRIPTION OF THE PREFERRED EMBODIMENT

Figure 1:
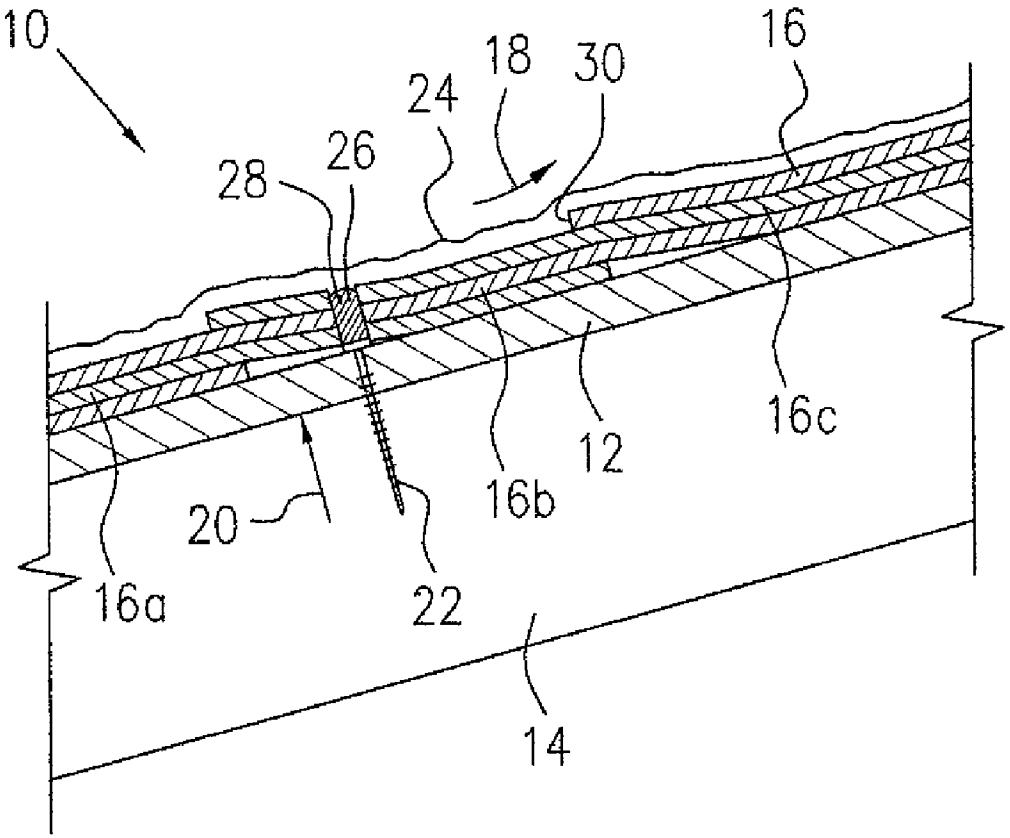
FIG. 1 is a partial cross-sectional view of a roof structure of buildings (not shown) according to one embodiment, showing a fastener driven down through the shingles and roof sheathing into the underlying roof frame with the enlarged top of the fastener driven through all layers of the overlapping shingles to abut the roof sheathing.

In FIG. 1, a roof structure generally indicated by numeral 10 is illustrated which includes a roof sheathing 12 which is supported on a plurality of trusses or rafters (referring to underlying frames hereinafter) 14 in an inclined orientation to facilitate rain drainage. A plurality of shingles 16 including particular shingles 16*a*, 16*b*, 16*c*, such as asphalt roof shingles, are laid on the top surface of the roof sheathing 12 in rows in an overlapping and offset pattern to allow water to run off without penetrating through the shingles 16. In particular, an upper end portion of one shingle 16 is directly attached to the roof sheathing 12 and is covered at least by another adjacent shingle 16 which is also attached at its upper end portion directly to the roof sheathing 12 at a relatively higher location while partially overlapping the relatively lower shingle 16, such as the adjacent shingles 16*a* and 16*b*.

According to the embodiment as illustrated in FIG. 1, shingles 16 on the roof sheathing 12 partially overlap in a more dense pattern such that the roof sheathing 12 is covered substantially by three layers of shingles 16, such as illustrated by shingles 16*a*, 16*b*, 16*c*. A low end portion of first shingle 16*a* is directly attached to the sheathing 12 by adhesive or by nails and is covered immediately above by a middle portion of shingle 16*b* which is attached at its upper end portion directly to the roof sheathing 12 in a similar fashion at a relatively higher location. The overlapping upper end portion of shingle 16*a* and the middle portion of shingle 16*b* are further covered immediately above shingle 16*b* by a low end portion of shingle 16*c* which is attached at its upper end portion in a similar fashion directly to the roof sheathing 12 at a further higher location (not shown). The roof sheathing 12 is secured to the roof frame 14, for example by nails or screws (not shown), prior to installation of roof shingles 16 during the construction of the roof structure 10.

It is desirable to reinforce the roof structure 10 in hurricane and tornado high risk areas. Winds at high velocities indicated by arrow 18 have a tendency to lift the lower end portion of shingles 16 and then tear the shingles off the roof structure 10. In certain areas, the high velocity winds 18 over the top of the roof structure 10 create a low pressure air zone immediately above the roof structure 10, resulting in a pressure differential across the roof sheathing 12 and thus a lifting force indicated by arrow 20, acting on the roof sheathing 12. The roof sheathing 12 with shingles 16 thereabove, may be torn off when the lifting force 20 increases to a destructive level. A retrofitting operation to reinforce the attachment of roof sheathing 12 to the underlying roof frames 14, conventionally requires removal of all shingles and then replacement of roof shingles 16 after the retrofitting reinforcement of the roof structure 10 is completed.

According to one embodiment of the present invention, FIG. 1 also illustrates a method for securing the roof sheathing 12 and shingles 16 in a retrofitting reinforcement of the existing roof structure 10. A plurality of fasteners, for example screws 22 (only one is shown in FIG. 1), are driven down through selected singles 16 and further through the roof sheathing 12 in a selected area of the roof structure 10, into at least one of the underlying roof frames 14. The selected area of the roof structure, for example a front side of the roof structure facing the winds 18, is prone to damage caused by the high velocity winds 18 and the resultant uplift force 20 acting on the roof sheathing 12. In such areas, the winds 18 also have a tendency to pry off the leading ends 30 of the shingles 16.

A durable water-resistant coating 24 is then applied to the structure 10 to form a continuous membrane thereby sealing the fastener penetrations against water entry while preventing winds from "prying off" the shingles 16. In this embodiment, the durable water-resistant coating 24 is applied to form the continuous membrane over the selected area of the roof structure, covering exposed ends and sides seamlessly with exposed top surfaces of all shingles 16 in the selected area, including those shingles in the area without the fasteners 22 driven therethrough. It may be desirable to extend the selected area to the entire top surface of the roof structure and therefore, the continuous membrane seamlessly covers the entire top surface of the roof structure.

It is understood that the shingles are selected to receive the fasteners to be driven through because those shingles in the selected area are located above one of the underlying roof frames and allow an appropriate point thereon for a fastener to align with said underlying roof frame.

Figure 2:
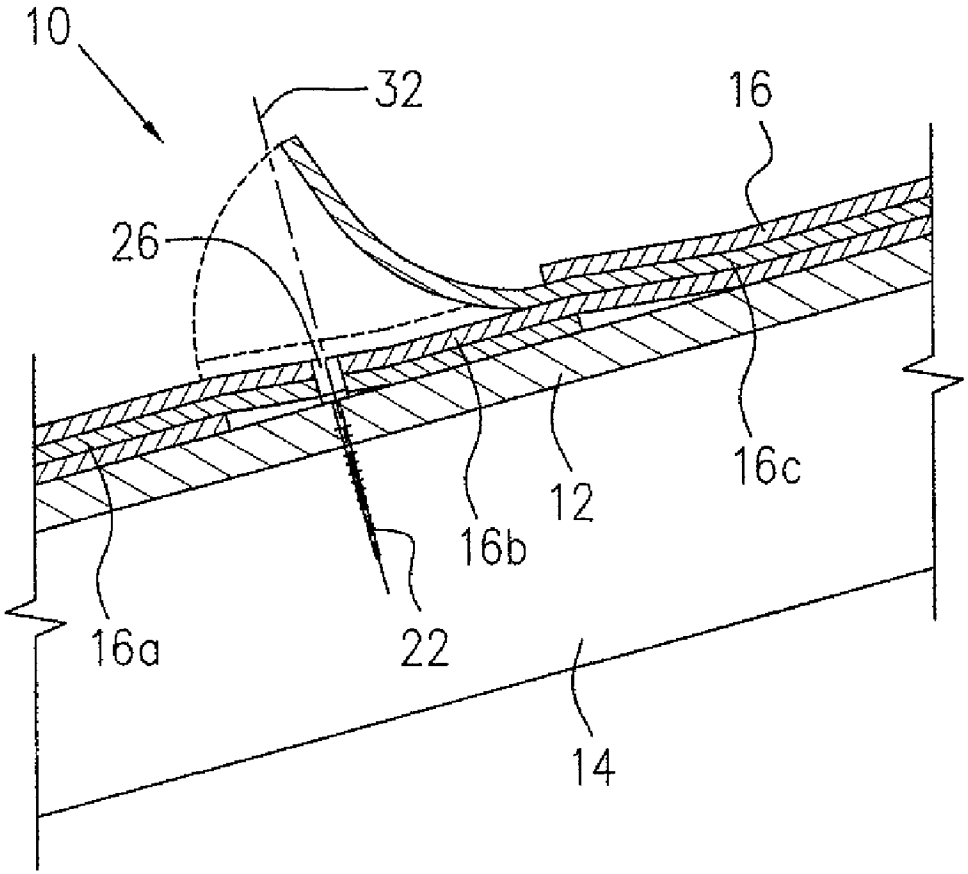
FIG. 2 is a partial cross-sectional view of the roof structure according to another embodiment, showing a step of the method to force a low end portion of an upper shingle to be lifted to allow the fastener to be driven through a point of shingles below to allow a coverage of the fastener's top when the low end portion of the upper shingle returns to its original position.

The screws 22 may be driven into a depth such that the enlarged top of the screw 20 is forced to penetrate one or more layers of overlapping shingles 16, resulting in a plurality of holes 26 in the shingles 16 exposing the tops of the respective screws 22. In the embodiment shown in FIG. 1, the enlarged top of screw 22 is driven down to penetrate all three layers of overlapping shingles 16 and to abut the top surface of the roof sheathing 12, which provides a more secure attachment of the roof sheathing 12 to the underlying roof frames 14. The respective holes 26 may be filled with a caulking material 28 prior to applying the coating 24, if it is desired. A preferred option is to fill the coating 24 into the respective holes 26 when applying the coating 24 over the shingles 16, instead of filling the holes 26 with a caulking material prior to applying the coating 24. The additional screws 22 added during retrofitting of the roof structure 10 reinforces the attachment of the roof sheathing 12 to the underlying roof frames 14 at selected areas. The coating 24 forms a durable water-resistant membrane over the entire top surface of the roof structure 10 which advantageously prevents water penetration through passages defined between the added screws 22 and the surrounding roof structure 10 including through shingles 16, roof sheathing 12 and the underlying roof frames 14 and also advantageously forms a barrier which prevents high velocity winds 18 from "prying" under a leading edge 30 of the respective shingles 16 and thus forcing the shingles 16 to break away from the roof structure 10.

Where shingles remain suitably flexible and sound, a useful variation according to another embodiment of the present invention is shown in FIG. 2, in which a lower end portion of shingle 16*c* which is laid above and overlaps the middle portion of shingle 16*b* and the upper portion of shingle 16*a*, is lifted to an extent which allows a tool such as screw driver (not shown) to be positioned (as indicated by line 32) to drive one screw 22 through shingles 16*a*, 16*b* into the roof sheathing 12 and into the underlying roof frames 14. When the lower end portion of shingle 16*c* returns to its original position as shown by the broken line, the top of the screw 22 and the resultant holes 26 as a passage of penetration of the enlarged top of the screw (if any) are well covered by the lower end portion of shingle 16*c*. This step is repeated in the retrofitting work for driving each of the added screws 22 in the selected area of the roof structure 10. After all screws 22 are fastened to the roof structure 10 in the manner shown in FIG. 2, a coating (not shown) similar to the coating 24 in FIG. 1 is applied to the top of the roof structure 10 to form a membrane over the entire surface of the roof structure, covering the exposed surface of all the shingles 16.

The retrofitting method for reinforcing the existing roof structure against winds according to the present invention, is applicable to various types of shingles other than the asphalt shingles described above. The roof structure as described above is taken as an example to illustrate the principle of the present invention but does not limit the application of this invention. When shingles other than suitably flexible and sound asphalt shingles may have a brittle condition which may not readily allow a fold-back action as illustrated in FIG. 2, the fasteners may best be installed directly through all layers of shingles as shown in FIG. 1. When shingle installation methods do not allow such a fold-back action of the shingles, the embodiment of FIG. 1 is also suggested.

Screws have been taken as an example of the fasteners to be installed in the roof structure during the retrofitting operation. However, other types of fasteners such as nails, U-shaped fasteners, etc. may be used in the retrofitting operation.

The fasteners may be driven only in areas known to be subject to extreme uplift forces from strong winds from any direction such as along side roof ridges and near eaves and rakes, because existing nailing is usually more than adequate in less-loaded areas which usually comprise the major portion of the roof surfaces. That knowledge-based practice can reduce costs substantially. However, the subsequent coating preferably covers all of the shingled areas because the wind's maximum prying action can occur essentially anywhere. Shingles, most commonly asphalt shingles, are prone to failure as wind pressures pry under their leading edges and laps. The durable and water-resistant coatings which are currently available, such as transparent acrylic coatings, can protect asphalt shingles almost indefinitely if renewed at proper intervals, while allowing the shingle's colour and texture to show through attractively.

When the combination of fastener installation and coating application is applied to the roof of an existing structure, the roof sheathing and shingles become much more resistant to removal or even to significant damage from high velocity winds, therefore protecting the structure as well as neighbouring structures.

The above description is meant to be exemplary only and one skilled in the art will recognize that changes may be made to the embodiments described without departing from the scope of the invention disclosed. Modifications which fall within the scope of the present invention will be apparent to those skilled in the art in light of a review of this description and such modifications are intended to fall within the scope of the appended claims.

I claim:

1. A method for securing a roof sheathing and shingles in a retrofitting reinforcement of an existing roof structure, the shingles being laid on the roof sheathing in a partially overlapping pattern, the method comprising:

a) driving a plurality of fasteners down through selected shingles and the roof sheathing in a selected area of the roof structure into at least one of underlying roof frames, thereby causing an enlarged top portion of the fasteners to be driven through the selected shingles to abut the sheathing; and b) applying a water-resistant coating to the roof structure to form a continuous membrane over the selected area of the roof structure covering exposed ends and sides seamlessly with exposed top surfaces of all shingles in the selected area, thereby sealing fastener penetrations against water entry while preventing winds from prying off the shingles.

2. The method as defined in claim 1 wherein the coating is applied to exposed surfaces of all the shingles of the roof structure, thereby the continuous membrane covering an entire top surface of the roof structure.

3. The method as defined in claim 1, wherein the coating is filled into a plurality of holes created by the enlarged top portions of the fasteners driven through the selected shingles.

4. The method as defined in claim 1 wherein prior to step (a), a low end portion of a shingle which is laid above and overlaps another one of the selected shingles, is lifted to allow driving one of the fasteners through a point of said another one shingle, and then the low end portion returns to an original position to cover the top of the fastener prior to applying the coating.

5. A method for retrofitting reinforcement of an existing roof structure, the roof structure including a roof sheathing supported on a plurality of underlying roof frames, and a plurality of shingles laid on the roof sheathing in a partially overlapping pattern, the method comprising:

a) driving a plurality of fasteners down through selected shingles and through the roof sheathing into selected underlying roof frames, each of the fasteners being driven through at least one layer of overlapping shingles to cause an enlarged portion of a top of the fastener to abut the roof sheathing; and b) applying a water-resistant coating to form a continuous membrane over an entire surface of the roof structure, seamlessly covering the tops of the respective fasteners and exposed top surfaces with exposed ends and sides of all the shingles, thereby sealing fastener penetrations against water entry while preventing winds from prying off the shingles.

* * * * *